US010550761B2

(12) United States Patent
Lombard et al.

(10) Patent No.: US 10,550,761 B2
(45) Date of Patent: Feb. 4, 2020

(54) TURBOCHARGER COMPRESSOR HAVING ADJUSTABLE-TRIM MECHANISM

(71) Applicant: Honeywell International Inc., Morris Plains, NJ (US)

(72) Inventors: Alain Lombard, Vosges (FR); Stephane Pees, Ceintrey (FR); Hani Mohtar, Chaumousey (FR); Stephane Doise, Epinal (FR)

(73) Assignee: Garrett Transportation I Inc., Torrance, CA (US)

( * ) Notice: Subject to any disclaimer, the term of this patent is extended or adjusted under 35 U.S.C. 154(b) by 62 days.

(21) Appl. No.: 15/904,493

(22) Filed: Feb. 26, 2018

(65) Prior Publication Data

US 2019/0264604 A1 Aug. 29, 2019

(51) Int. Cl.

| | |
|---|---|
| ***F02B 37/24*** | (2006.01) |
| ***F04D 29/28*** | (2006.01) |
| ***F04D 29/42*** | (2006.01) |
| ***F04D 29/46*** | (2006.01) |

(52) U.S. Cl.

CPC ..... *F02B 37/24* (2013.01); *F04D 29/284* (2013.01); *F04D 29/4206* (2013.01); *F04D 29/462* (2013.01)

(58) Field of Classification Search

CPC ..... F02B 37/00; F02B 37/16; F02B 37/225; F02B 37/24; F02B 39/00; F04D 17/10; F04D 25/04; F04D 27/002; F04D 27/0246; F04D 27/0253; F04D 29/4213; F04D 29/462; F04D 29/464; F04D 29/681; F05D 2220/40; F16K 3/03; Y02T 10/144

USPC ..... 415/163–164; 60/605.1

See application file for complete search history.

(56) References Cited

U.S. PATENT DOCUMENTS

2004/0096316 A1* 5/2004 Simon ..... F01D 17/141 415/151

2014/0308110 A1* 10/2014 Houst ..... F02B 37/22 415/1

* cited by examiner

*Primary Examiner* — Patrick D Maines
*Assistant Examiner* — Dapinder Singh
(74) *Attorney, Agent, or Firm* — John C. James

(57) ABSTRACT

A centrifugal compressor for a turbocharger includes an inlet-adjustment mechanism operable to move between an open position and a closed position. The inlet-adjustment mechanism includes a plurality of blades disposed about the compressor air inlet and located within an annular space within the air inlet wall. The blades are pivotable about respective pivot points such that the blades extend radially inward from the annular space into the air inlet when the blades are in the closed position so as to form an orifice of reduced diameter relative to a nominal diameter of the inlet. The blades include lever arms that engage the outer periphery of a rotatable unison ring that is linked to a linear actuator for rotating the unison ring so as to pivot the blades.

13 Claims, 8 Drawing Sheets

TURBOCHARGER COMPRESSOR HAVING ADJUSTABLE-TRIM MECHANISM

BACKGROUND OF THE INVENTION

The present disclosure relates to centrifugal compressors, such as used in turbochargers, and more particularly relates to centrifugal compressors in which the effective inlet area or diameter can be adjusted for different operating conditions.

An exhaust gas-driven turbocharger is a device used in conjunction with an internal combustion engine for increasing the power output of the engine by compressing the air that is delivered to the air intake of the engine to be mixed with fuel and burned in the engine. A turbocharger comprises a compressor wheel mounted on one end of a shaft in a compressor housing and a turbine wheel mounted on the other end of the shaft in a turbine housing. Typically, the turbine housing is formed separately from the compressor housing, and there is yet another center housing connected between the turbine and compressor housings for containing bearings for the shaft. The turbine housing defines a generally annular chamber that surrounds the turbine wheel and that receives exhaust gas from an engine. The turbine assembly includes a nozzle that leads from the chamber into the turbine wheel. The exhaust gas flows from the chamber through the nozzle to the turbine wheel and the turbine wheel is driven by the exhaust gas. The turbine thus extracts power from the exhaust gas and drives the compressor. The compressor receives ambient air through an inlet of the compressor housing and the air is compressed by the compressor wheel and is then discharged from the housing to the engine air intake.

Turbochargers typically employ a compressor wheel of the centrifugal (also known as "radial") type because centrifugal compressors can achieve relatively high pressure ratios in a compact arrangement. Intake air for the compressor is received in a generally axial direction at an inducer portion of the centrifugal compressor wheel and is discharged in a generally radial direction at an exducer portion of the wheel. The compressed air from the wheel is delivered to a volute, and from the volute the air is supplied to the intake of an internal combustion engine.

The operating range of the compressor is an important aspect of the overall performance of the turbocharger. The operating range is generally delimited by a surge line and a choke line on an operating map for the compressor. The compressor map is typically presented as pressure ratio (discharge pressure Pout divided by inlet pressure Pin) on the vertical axis, versus corrected mass flow rate on the horizontal axis. The choke line on the compressor map is located at high flow rates and represents the locus of maximum mass-flow-rate points over a range of pressure ratios; that is, for a given point on the choke line, it is not possible to increase the flow rate while maintaining the same pressure ratio because a choked-flow condition occurs in the compressor.

The surge line is located at low flow rates and represents the locus of minimum mass-flow-rate points without surge, over a range of pressure ratios; that is, for a given point on the surge line, reducing the flow rate without changing the pressure ratio, or increasing the pressure ratio without changing the flow rate, would lead to surge occurring. Surge is a flow instability that typically occurs when the compressor blade incidence angles become so large that substantial flow separation arises on the compressor blades. Pressure fluctuation and flow reversal can happen during surge.

In a turbocharger for an internal combustion engine, compressor surge may occur when the engine is operating at high load or torque and low engine speed, or when the engine is operating at a low speed and there is a high level of exhaust gas recirculation (EGR). Surge can also arise when an engine is suddenly decelerated from a high-speed condition. Expanding the surge-free operation range of a compressor to lower flow rates is a goal often sought in compressor design.

Applicant's U.S. patent application Ser. No. 15/446,054 filed on Mar. 1, 2017, which claims the benefit of the filing date of Provisional Application No. 62/324,488 filed on Apr. 20, 2016, the entire disclosures of said applications being hereby incorporated herein by reference, describes mechanisms and methods for a centrifugal compressor that can enable the surge line for the compressor to selectively be shifted to the left (i.e., surge is delayed to a lower flow rate at a given pressure ratio). One embodiment described in said applications comprises a turbocharger having the following features:

a turbine housing and a turbine wheel mounted in the turbine housing and connected to a rotatable shaft for rotation therewith, the turbine housing receiving exhaust gas and supplying the exhaust gas to the turbine wheel;

a centrifugal compressor assembly comprising a compressor housing and a compressor wheel mounted in the compressor housing and connected to the rotatable shaft for rotation therewith, the compressor wheel having blades and defining an inducer portion, the compressor housing having an air inlet wall defining an air inlet for leading air generally axially into the compressor wheel, the compressor housing further defining a volute for receiving compressed air discharged generally radially outwardly from the compressor wheel; and a compressor inlet-adjustment mechanism disposed in the air inlet of the compressor housing and pivotable radially inwardly and radially outwardly between an open position and a closed position, the inlet-adjustment mechanism comprising a plurality of blades disposed about the air inlet and each pivotable about one end of the blade, the blades pivoting radially inwardly through a slot in the air inlet wall when the blades are in the closed position so as to form an orifice of reduced diameter relative to a nominal diameter of the inlet.

Applicant is also the owner of additional applications directed to other inlet-adjustment mechanisms employing moving blades, including U.S. application Ser. No. 15/446,090 filed on Mar. 1, 2017, the entire disclosure of which is hereby incorporated herein by reference.

The present disclosure concerns inlet-adjustment mechanisms generally of the type described in the aforementioned '054, '488, and '090 applications, and particularly concerns modifications or redesigns of such mechanisms that aim to improve upon certain aspects of said mechanisms.

BRIEF SUMMARY OF THE DISCLOSURE

One such aspect of the aforementioned inlet-adjustment mechanisms for which improvement is sought concerns the actuation force required for moving the blades of the inlet-adjustment mechanism between the open and closed positions. The inlet-adjustment mechanism is subject to significant aerodynamic load, particularly at low-flow and high compression ratio conditions, which correspond to operating conditions for which the blades typically are closed. Thus, the blades experience a significant pressure differential between their upstream and downstream faces, which urges the blades in the downstream direction against the compressor housing structure immediately adjacent thereto. These aerodynamic loads, combined with internal friction within the inlet-adjustment mechanism, operate to resist the actuator that moves the mechanism between the open and closed positions. This results in the need for a significant amount of actuation force from the actuator, meaning that a larger and more-expensive actuator is required in order to attain the speed of actuation that is needed for proper compressor operation.

Accordingly, Applicant has sought to mitigate this issue.

In accordance with one embodiment disclosed herein, there is described a turbocharger having a combination of features that cooperate to reduce the required actuator force for the inlet-adjustment mechanism. Thus, one turbocharger in accordance with the embodiment of the invention includes:

a turbine housing and a turbine wheel mounted in the turbine housing and connected to a rotatable shaft for rotation therewith, the turbine housing receiving exhaust gas and supplying the exhaust gas to the turbine wheel;

a centrifugal compressor assembly comprising a compressor housing and a compressor wheel mounted in the compressor housing and connected to the rotatable shaft for rotation therewith, the compressor wheel having blades and defining an inducer portion, the compressor housing having an air inlet wall defining an air inlet for leading air generally axially into the compressor wheel, the compressor housing further defining a volute for receiving compressed air discharged generally radially outwardly from the compressor wheel, the air inlet wall defining an annular space surrounding the air inlet and open to the air inlet at a radially inner end of the annular space; and a compressor inlet-adjustment mechanism disposed in the annular space of the air inlet wall and movable between an open position and a closed position, the inlet-adjustment mechanism comprising a plurality of blades disposed within the annular space, the blades collectively circumscribing an orifice, each blade having an upstream surface relatively farther from and facing away from the compressor wheel and a downstream surface relatively closer to and facing toward the compressor wheel, the blades each pivoting radially inwardly from the annular space into the air inlet when the blades are in the closed position so as to cause the orifice to have a reduced diameter relative to a nominal diameter of the inlet; and a unison ring surrounding the blades, the unison ring being rotatable about a rotational axis of the turbocharger, the unison ring having a radially inner peripheral surface and a radially outer peripheral surface, the radially outer peripheral surface defining a plurality of circumferentially spaced notches, one said notch for each said blade, wherein each of the blades includes an orifice portion at one end of the blade, a lever arm at an opposite end of the blade, and a mounting portion disposed intermediate the lever arm and orifice portion, each blade being supported by a pivot pin affixed to the mounting portion and rotatably engaged in a bore in the compressor housing such that the blade pivots about an axis defined by the bore, the mounting portions of the blades being disposed radially inward from the radially inner periphery of the unison ring, the lever arm of each blade including a support portion that extends radially outwardly from the mounting portion, the support portion passing adjacent to a downstream face of the unison ring and axially supporting the unison ring, each lever arm further including a hook portion that extends axially from a radially outer end of the support portion and is engaged in a respective one of the notches in the radially outer periphery of the unison ring, whereby rotation of the unison ring imparts pivotal movement to the blades via engagement of the hook portions of the lever arms in the notches in the radially outer periphery of the unison ring.

In one embodiment, the support portion of each blade includes a raised dimple that makes contact with the downstream face of the unison ring and spaces a remainder of the support portion from said downstream face. The dimples reduce the amount of surface area contact between the unison ring and the blades, thereby reducing frictional resistance to unison ring rotation.

In one embodiment of the invention, each blade includes a ring-centering surface disposed on the mounting portion of the blade, the ring-centering surfaces of the blades contacting the radially inner periphery of the unison ring and collectively serving to radially position the unison ring such that the rotational axis of the unison ring is substantially coaxial with the rotation axis of the turbocharger.

In accordance with one embodiment, each blade and the pivot pin therefor comprise an integral one-piece structure.

According to one embodiment, a majority of the radially outer periphery of the unison ring lies on a circle of radius RO from the rotational axis but localized regions of the radially outer periphery in the vicinity of the notches are bulged radially outwardly to a radius RO+ΔR so that the notches lie at a radius greater than RO.

The turbocharger can also include a linear actuator operable to rotate the unison ring, the actuator including an actuator rod, and the compressor housing defining a rod bore extending along a direction tangential to the radially outer periphery of the unison ring. The actuator rod is disposed in the rod bore and is linearly movable therein. The compressor housing defines an opening that proceeds radially outwardly into the rod bore at a distal end of the actuator rod, and the unison ring defines a protrusion extending radially outward from the radially outer periphery of the unison ring. The protrusion passes through said opening into the rod bore and engages the distal end of the actuator rod such that linear movement of the actuator rod is transmitted by the protrusion to the unison ring so as to rotate the unison ring.

In accordance with one embodiment of the invention, frictional resistance to movement of the unison ring, blades, and actuator rod of the inlet-adjustment mechanism is reduced by constructing the blades and their pivot pins of plastic (for example, made by injection molding). Additionally, the actuator rod can comprise a metal rod but the distal end of the actuator rod can include a plastic cover (for example, formed by overmolding around the metal rod). Accordingly, the unison ring engages plastic surfaces of the blades and the actuator rod. The unison ring advantageously is made of metal, and so providing plastic (low-friction) engagement surfaces for the unison ring leads to a reduction in overall frictional resistance to mechanism movement.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 1:
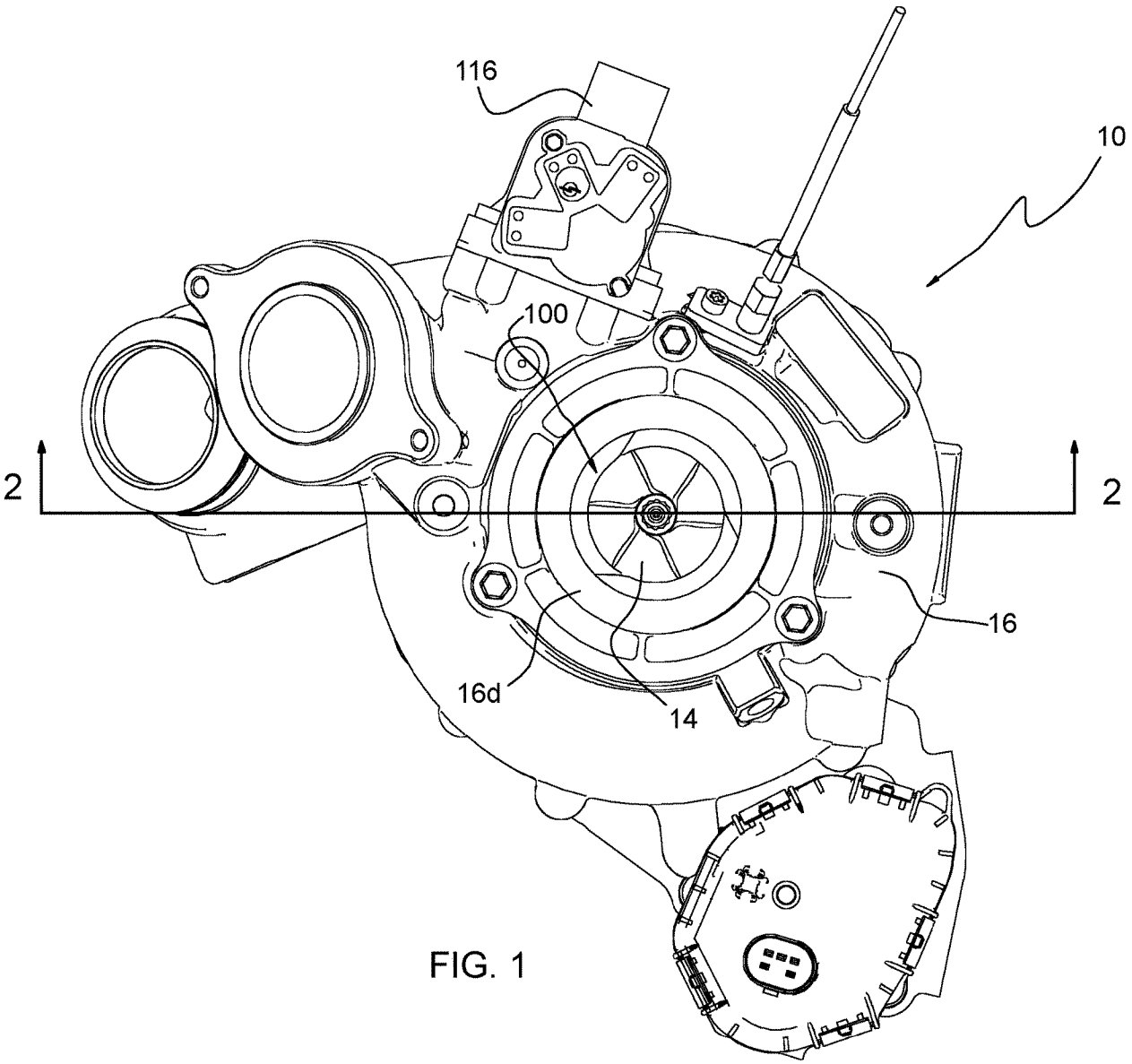
FIG. 1 is an end view of a turbocharger in accordance with one embodiment of the invention, looking axially from the compressor end toward the turbine end of the turbocharger.
Figure 3:
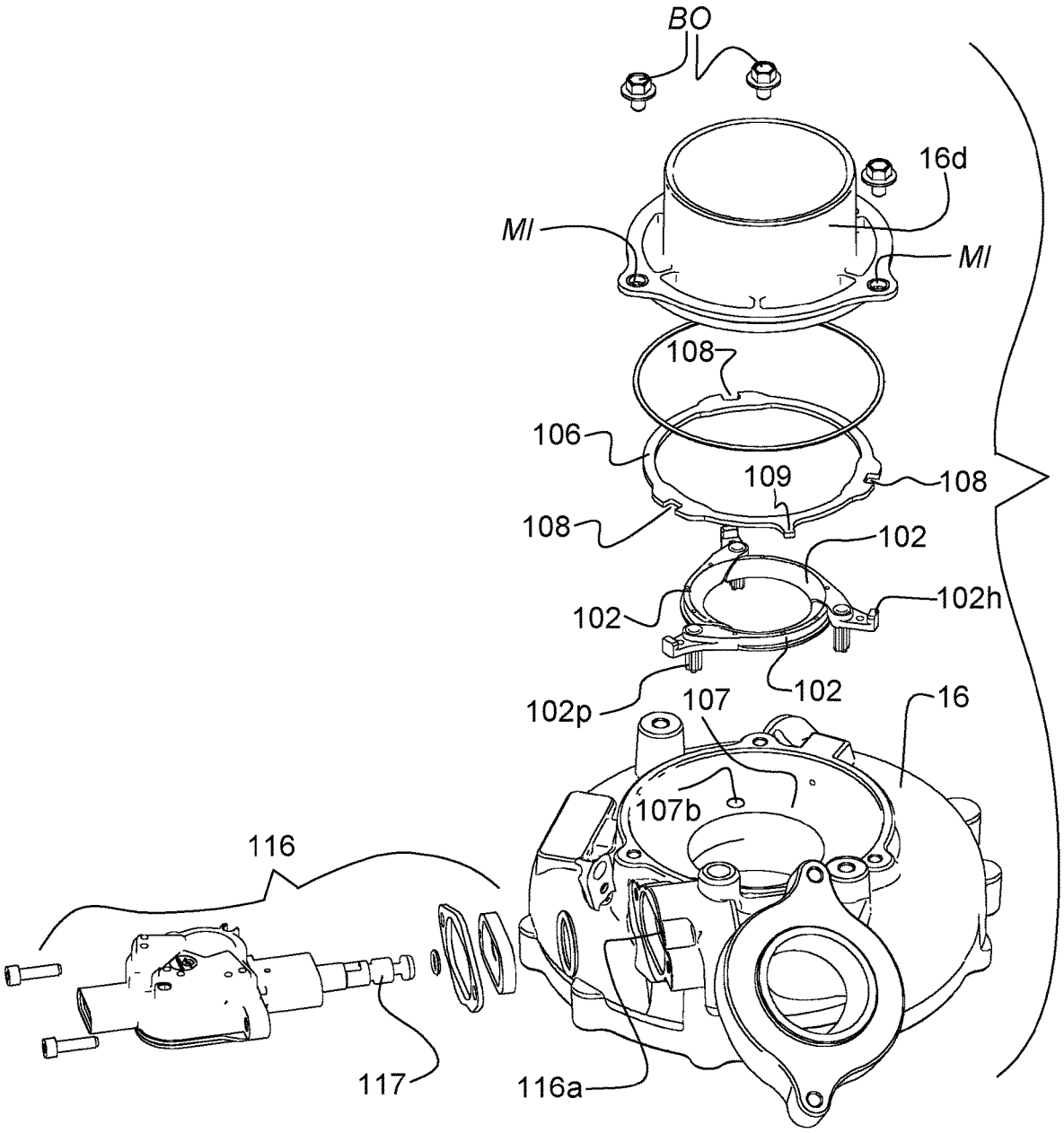
FIG. 3 is a partially exploded view of the compressor portion of the turbocharger of FIG. 1.
Figure 4:
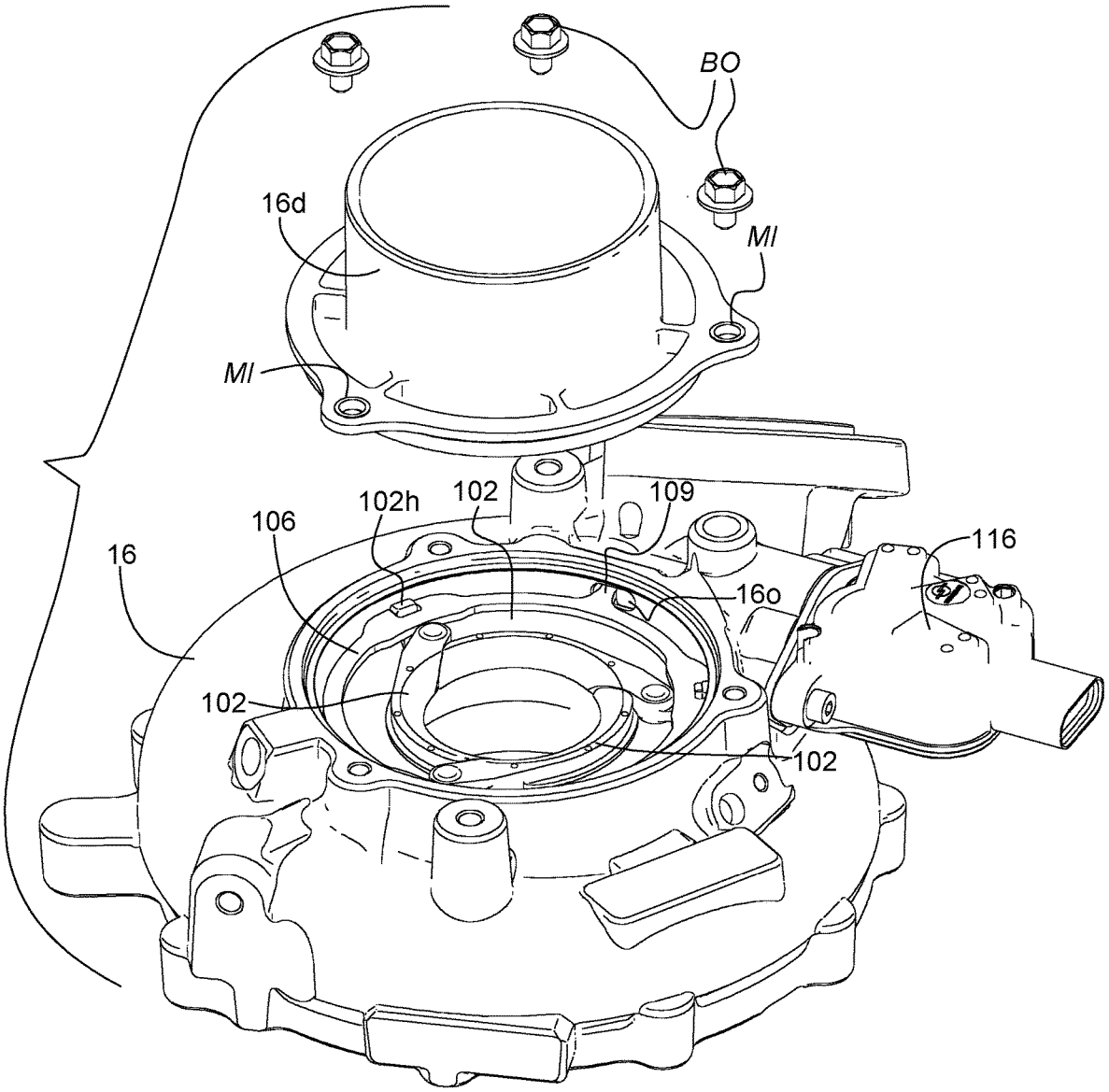
Figure 5:
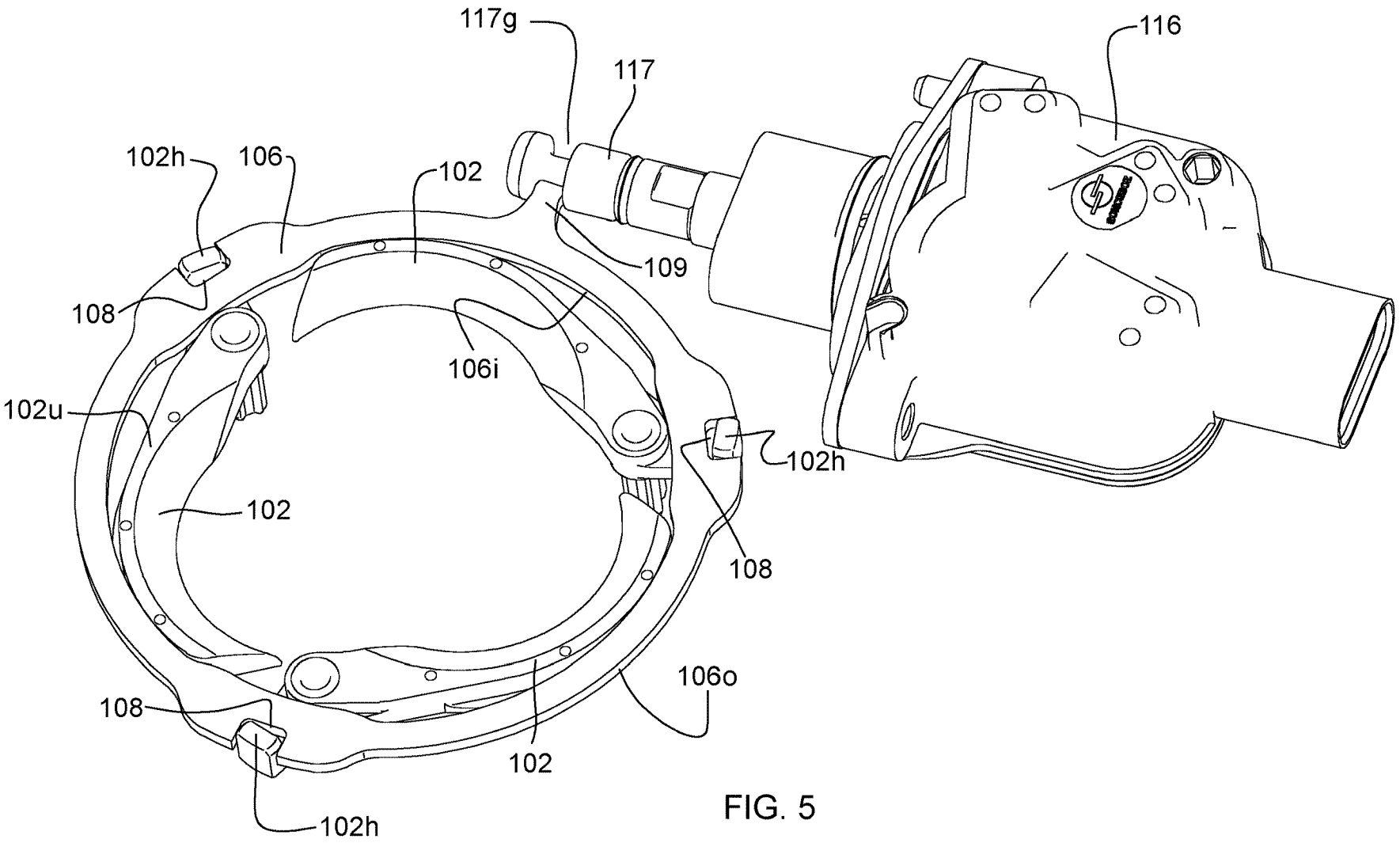
Figure 6:
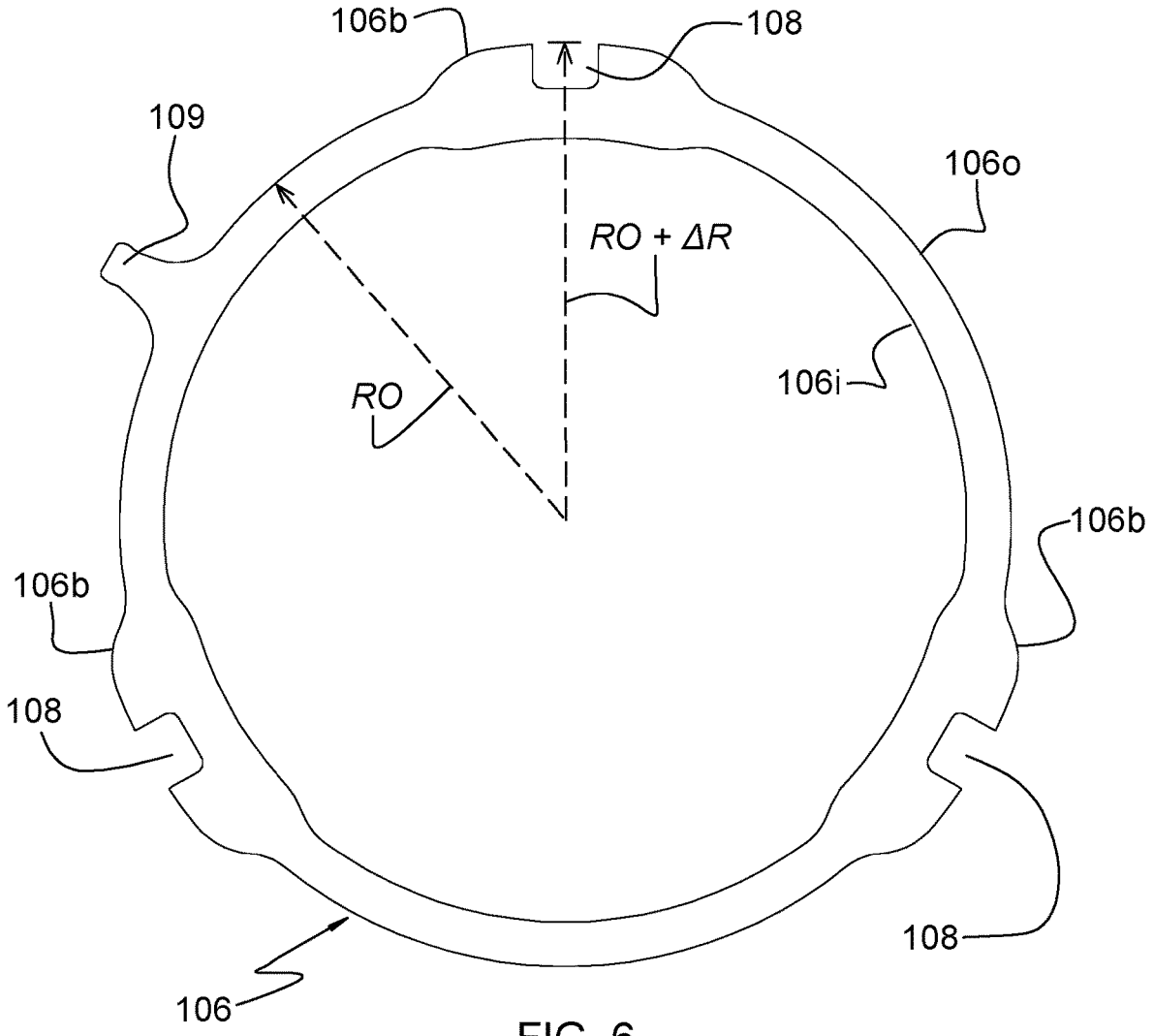
Figure 7:
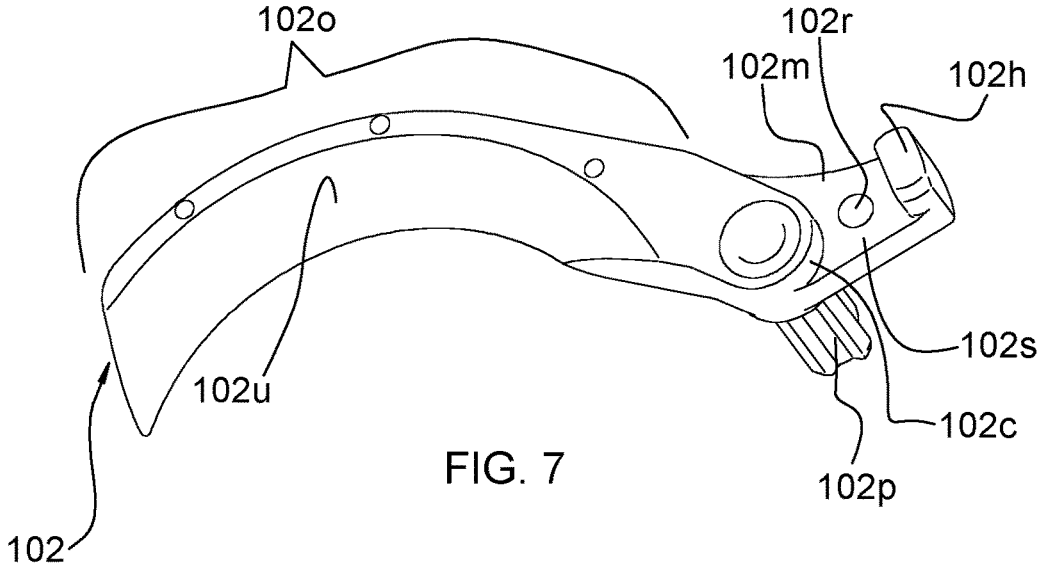
Figure 8:
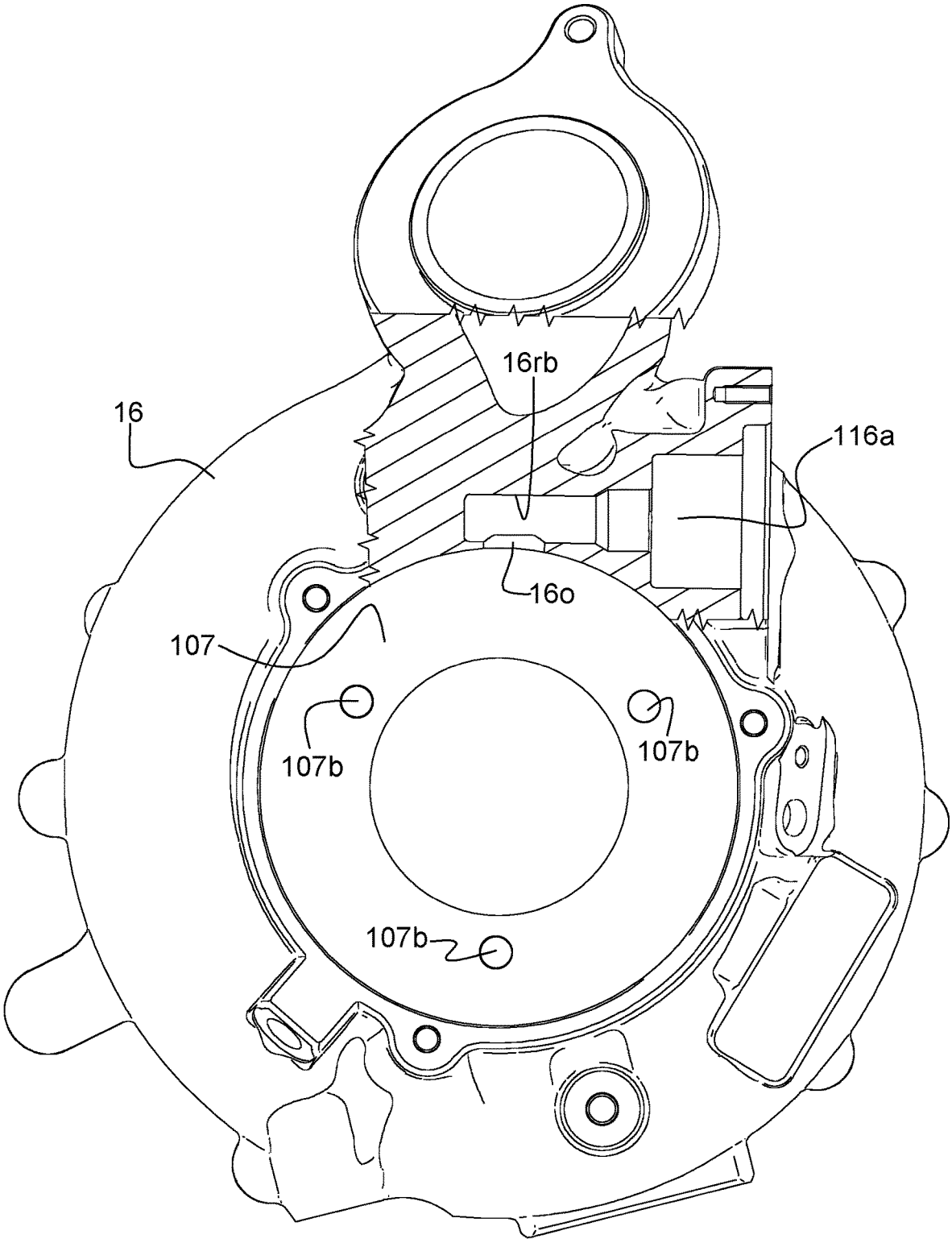
Figure 9:
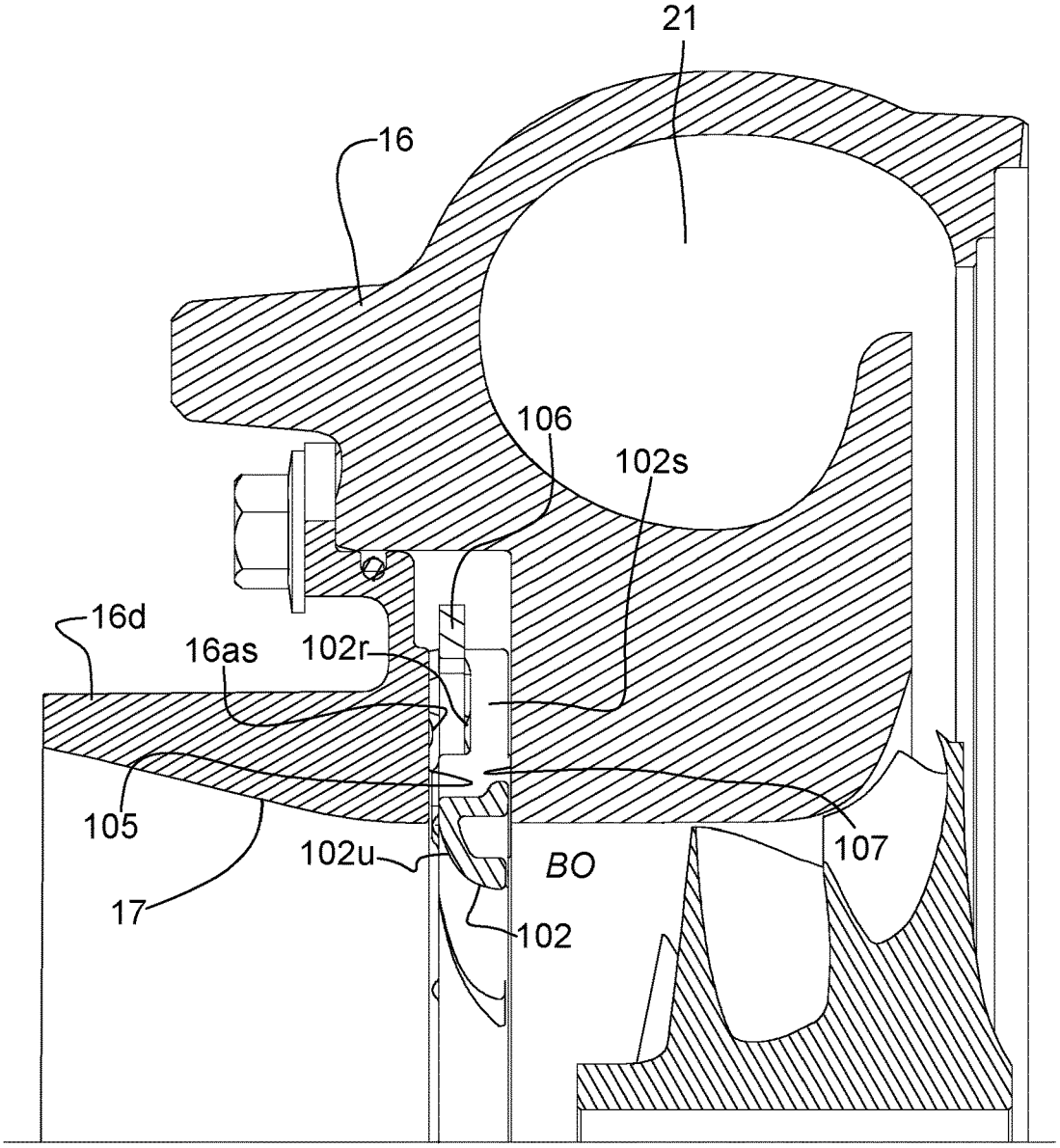
Figure 10:
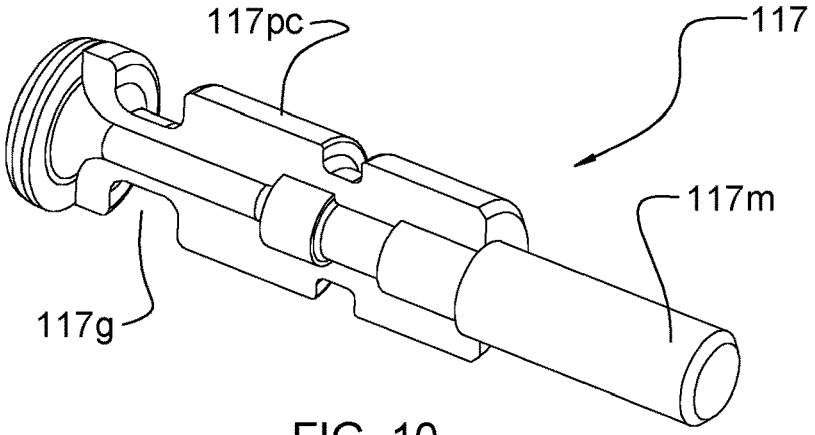

FIG. 4 an isometric view of the compressor housing assembly of FIG. 3, with the compressor cover (inlet duct member) exploded away so that the inlet-adjustment mechanism is visible;

FIG. 5 is an isometric view of a partial assembly of the inlet-adjustment mechanism and the actuator therefore, with the inlet-adjustment mechanism in an open position, as viewed from the upstream side of the mechanism;

FIG. 6 is a plan (axial) view of the unison ring for the inlet-adjustment mechanism in accordance with an embodiment of the invention;

FIG. 7 is an isometric view of a blade of the inlet-adjustment mechanism, showing the upstream surface of the blade;

FIG. 8 is an axial view of the compressor housing in accordance with an embodiment of the invention, with the housing partially broken away to show details of the receptacle for the actuator and the rod bore for the actuator rod;

FIG. 9 is a cross-sectional view through the compressor housing assembly and inlet-adjustment mechanism of the turbocharger of FIG. 1; and FIG. 10 is an isometric view, partly in section, of the actuator rod in accordance with an embodiment of the invention.

DETAILED DESCRIPTION OF THE DRAWINGS

The present inventions now will be described more fully hereinafter with reference to the accompanying drawings, in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

In the present disclosure, the term "orifice" means "opening" without regard to the shape of the opening. Thus, an "orifice" can be circular or non-circular. Additionally, when the blades of the inlet-adjustment mechanism are described as pivoting "radially" inwardly or outwardly, the term "radially" does not preclude some non-radial component of movement of the blades (for example, the blades may occupy a plane that is angled slightly with respect to the rotational axis of the compressor, such that when the blades pivot radially inwardly and outwardly, they also move with a small axial component of motion; alternatively, the blades may pivot and translate, such as in a helical type motion).

Figure 2:
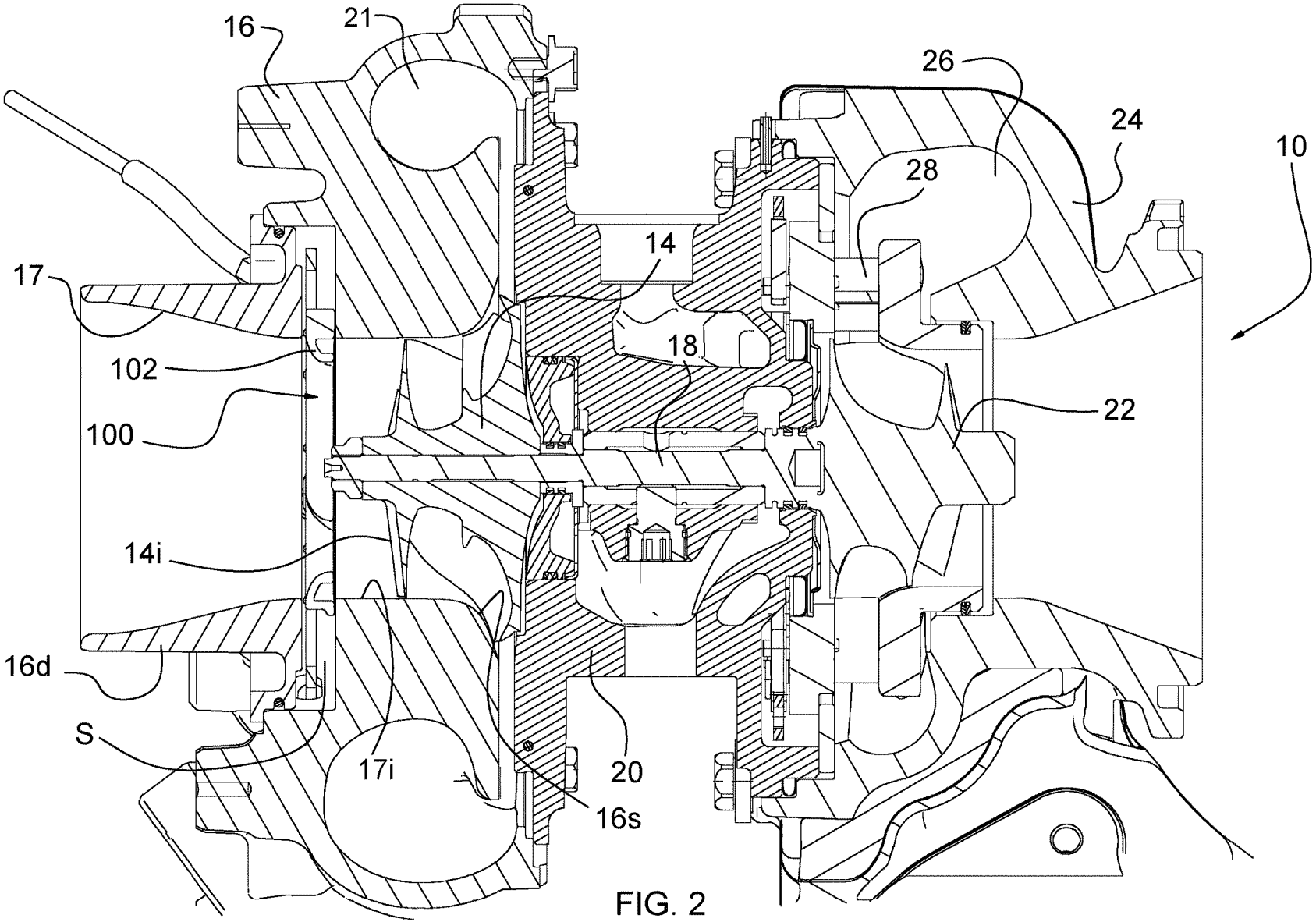
FIG. 2 is a cross-sectional view of the turbocharger along line 2-2 in FIG. 1.

A turbocharger 10 in accordance with one embodiment of the invention is illustrated in axial end view in FIG. 1, and an axial cross-sectional view of the turbocharger is shown in FIG. 2. The turbocharger includes a compressor and a turbine. The compressor comprises a compressor wheel or impeller 14 mounted in a compressor housing 16 on one end of a rotatable shaft 18. The compressor housing includes a wall that defines an air inlet 17 for leading air generally axially into the compressor wheel 14. The shaft is supported in bearings mounted in a center housing 20 of the turbocharger. The shaft is rotated by a turbine wheel 22 mounted on the other end of the shaft from the compressor wheel, thereby rotatably driving the compressor wheel, which compresses air drawn in through the compressor inlet and discharges the compressed air generally radially outwardly from the compressor wheel into a volute 21 for receiving the compressed air. From the volute 21, the air is routed to the intake of an internal combustion engine (not shown) for boosting the performance of the engine.

The turbine wheel 22 is disposed within a turbine housing 24 that defines an annular chamber 26 for receiving exhaust gases from an internal combustion engine (not shown). The turbine housing also defines a nozzle 28 for directing exhaust gases from the chamber 26 generally radially inwardly to the turbine wheel 22. The exhaust gases are expanded as they pass through the turbine wheel, and rotatably drive the turbine wheel, which in turn rotatably drives the compressor wheel 14 as already noted.

With reference to FIGS. 1-4, in the illustrated embodiment, the wall that defines the air inlet 17 is formed in part by the compressor housing 16 and in part by a separate cover or inlet duct member **16*d* that is received into a cylindrical receptacle defined by the compressor housing. The portion of the air inlet 17 proximate the compressor wheel 14 defines a generally cylindrical inner surface 17*i* that has a diameter generally matched to the diameter of an inducer portion 14*i*** of the compressor wheel.

The compressor housing 16 defines a shroud surface **16*s*** that is closely adjacent to the radially outer tips of the compressor blades. The shroud surface defines a curved contour that is generally parallel to the contour of the compressor wheel.

In accordance with the invention, the compressor of the turbocharger includes an inlet-adjustment mechanism 100 disposed in the air inlet 17 of the compressor housing. The inlet-adjustment mechanism comprises a ring-shaped assembly and is disposed in an annular space defined between the compressor housing 16 and the separate inlet duct member **16*d*. The annular space is bounded between an upstream wall surface 105 and a downstream wall surface 107 (FIG. 9**). The inlet-adjustment mechanism is operable for adjusting an effective diameter of the air inlet into the compressor wheel. As such, the inlet-adjustment mechanism is movable between an open position and a closed position, and can be configured to be adjusted to various points intermediate between said positions.

With reference now to FIGS. 3-8, the inlet-adjustment mechanism comprises a plurality of blades 102 arranged about the central axis of the air inlet and each pivotable about a pivot pin **102*p* located at or near one end of the blade. In the illustrated embodiment, the pivot pins for the blades are journaled in bores 107*b* (FIGS. 3 and 8) in the downstream wall surface 107 of the compressor housing, such that the pivot pins can rotate in said bores. In this embodiment, the pivot pins are integral with and rigidly attached to the blades. The blades are arranged between the upstream wall surface 105 and the downstream wall surface 107**, with a small amount of axial clearance or play for the blades between those wall surfaces, so that the blades can freely pivot without binding.

The inlet-adjustment mechanism further comprises a unison ring 106 for imparting pivotal movement to the blades. The unison ring surrounds the assembly of the blades 102 and is substantially coplanar with the blades, and is rotatable about an axis that coincides with the rotation axis of the compressor wheel. The unison ring includes a plurality of recesses 108 and each blade includes an end portion that is engaged in a respective one of the recesses 108, as described in further detail below in connection with FIGS. 5-7 and 9.

Accordingly, rotation of the unison ring in one direction causes the blades 102 to pivot radially inwardly, and rotation of the unison ring in the other direction causes the blades to pivot radially outwardly. The assembly of the blades 102 and unison ring 106 is captively retained between the upstream wall surface 105 and the downstream wall surface 107.

The radially inner edges of the blades 102 include portions that preferably are generally circular arc-shaped and these edges collectively surround and bound a generally circular opening or orifice (although the degree of roundness varies depending on the positions of the blades, as further described below).

The range of pivotal movement of the blades is sufficient that the blades can be pivoted radially outwardly by rotation of the unison ring in one direction (clockwise in FIG. 5) to an open position as shown in FIG. 5, in which the blades are entirely radially outward of the inner surface 17*i* (FIG. 2) of the inlet. As such, in the open position of the blades, the inlet-adjustment mechanism does not alter the nominal inlet diameter as defined by the inlet surface 17*i*.

The blades can also be pivoted radially inwardly (by rotation of the unison ring in the opposite direction, counterclockwise in FIG. 5) to a closed position as shown in FIG. 9. In the closed position, the circular-arc edges along the radially inner sides of the blades collectively form an orifice. In the illustrated embodiment the orifice is substantially a circle in the closed position, having a diameter that is less than that of the inlet surface 17*i*. ("Substantially a circle" in the present disclosure means that the circular-arc edges all lie on the same circle and collectively occupy at least 80% of the circumference of that circle.) This has the consequence that the effective diameter of the inlet is reduced relative to the nominal inlet diameter. Furthermore, in a non-illustrated embodiment the blades can be pivoted an additional amount to a super-closed position in which there is some degree of overlap of adjacent blades, which is made possible by forming the respective overlapping edge portions of adjacent blades as complementing or male-female shapes. When the blades are in the super-closed position, the circular-arc edges of the blades collectively define an opening or orifice that is not perfectly circular but is effectively even smaller than the opening for the closed position. Thus, the inlet-adjustment mechanism causes the effective diameter of the inlet to be further reduced relative to the closed position. In this manner, the inlet-adjustment mechanism is able to regulate the effective diameter of the air inlet approaching the compressor wheel.

It should be noted, however, that it is not essential that the orifice defined by the inlet-adjustment mechanism be circular in the closed position. Alternatively, the orifice can be non-circular. The invention is not limited to any particular shape of the orifice.

As previously described, the blades 102 are actuated to pivot between their open and closed (and, optionally, super-closed) positions by the unison ring 106 that is rotatable about the center axis of the air inlet. Referring now to FIGS. 4-5, rotational motion is imparted to the unison ring by an actuator 116 that is received into a receptacle 116*a* (FIG. 3) defined in the compressor housing. The actuator includes an actuator rod 117 that extends through a rod bore 16*rb* (FIG. 8) defined in the compressor housing. The rod bore passes tangential to and radially outward of the unison ring 106. The wall of the compressor housing that lies radially outward of the unison ring defines an opening 16*o* that extends radially outwardly and connects with the rod bore. The unison ring defines a protrusion 109 (FIGS. 4 and 6) that passes through the opening 16*o* and engages a slot or groove 117*g* (FIG. 10) at the distal end of the actuator rod 117. The actuator is operable to extend and retract the rod 117 linearly along its length direction so as to rotate the unison ring 106 and thereby actuate the blades 102. Extending the rod pivots the blades towards the closed position and retracting the rod pivots the blades toward the open position.

As noted, the inlet-adjustment mechanism 100 enables adjustment of the effective size or diameter of the inlet into the compressor wheel 14. As illustrated in FIG. 2, when the inlet-adjustment mechanism is in the closed position, the effective diameter of the inlet into the compressor wheel is dictated by the inside diameter defined by the blades 102. In order for this effect to be achieved, the axial spacing distance between the blades and the compressor wheel must be as small as practicable, so that there is insufficient distance downstream of the blades for the flow to expand to the full diameter of the inducer portion of the compressor wheel 14 by the time the air encounters it. The inlet diameter is thereby effectively reduced to a value that is dictated by the blades.

At low flow rates (e.g., low engine speeds), the inlet-adjustment mechanism 100 can be placed in the closed position of FIGS. 2 and 6. This can have the effect of reducing the effective inlet diameter and thus of increasing the flow velocity into the compressor wheel. The result will be a reduction in compressor blade incidence angles, effectively stabilizing the flow (i.e., making blade stall and compressor surge less likely). In other words, the surge line of the compressor will be moved to lower flow rates (to the left on a map of compressor pressure ratio versus flow rate).

At intermediate and high flow rates, the inlet-adjustment mechanism 100 can be partially opened or fully opened as in FIG. 5. This can have the effect of increasing the effective inlet diameter so that the compressor regains its high-flow performance and choke flow essentially as if the inlet-adjustment mechanism were not present and as if the compressor had a conventional inlet matched to the wheel diameter at the inducer portion of the wheel.

In accordance with one aspect of the invention disclosed herein, the inlet-adjustment mechanism 100 includes features for reducing the frictional resistance of the inlet-adjustment mechanism to movement. As previously noted, the inlet-adjustment mechanism is subject to significant aerodynamic load, particularly at low-flow and high compression ratio conditions, which correspond to operating conditions for which the blades 102 typically are closed. Thus, the blades experience a significant pressure differential between their upstream and downstream faces, which urges the blades in the downstream direction against the compressor housing structure immediately adjacent thereto. These aerodynamic loads, combined with internal friction within the inlet-adjustment mechanism, operate to resist the actuator 116 that moves the mechanism between the open and closed positions. This results in the need for a significant amount of actuation force from the actuator, meaning that a larger and more-expensive actuator is required in order to attain the speed of actuation that is needed for proper compressor operation.

Features of the present invention can reduce the frictional resistance of the mechanism, as well as provide mechanical advantage to the linkage between the actuator, the unison ring, and the blades, the result being that the desired speed and reliability of actuation of the mechanism can be achieved without needing a large and expensive actuator. In accordance with a first aspect of the invention, the actuator-to-blade linkage is designed for improved mechanical advantage, as now explained. As best seen in FIG. 6, the unison ring 106 has a radially inner peripheral surface 106*i* and a radially outer peripheral surface 106*o*. The radially outer peripheral surface defines a plurality of circumferentially spaced notches 108, one said notch for each said blade 102. A majority of the circumference of the outer peripheral surface is circular, having a radius of RO. However, in the vicinity of each notch 108, the outer peripheral surface is bulged radially outwardly, as designated by reference numbers 106*b*, and the radius of the bulged portions of the outer peripheral surface is RO+ΔR, where the value of ΔR is at least as large as the radial depth of the notches 108. Accordingly, the notches 108 lie at a radius that is at least as large as RO.

With reference now to FIG. 7, each blade 102 has an orifice portion 102*o* that is the portion of the blade that actually forms, along with the orifice portions of the other two blades, the reduced-diameter orifice when the blades are closed. Joined to the orifice portion is a mounting portion 102*m*, which supports a pivot pin 102*p* affixed to the mounting portion. The mounting portions 102*m* of the blades are disposed radially inward from the radially inner periphery of the unison ring 106, as shown in FIG. 5. Joined to the mounting portion of each blade is a lever arm that includes a support portion 102*s* that extends radially outwardly from the mounting portion, the support portion passing adjacent to a downstream face of the unison ring 106 and axially supporting the unison ring (FIG. 9). Each lever arm further includes a hook portion 102*h* that extends axially from a radially outer end of the support portion 102*s* and is engaged in a respective one of the notches 108 in the radially outer periphery of the unison ring (FIG. 5).

The support portion 102*s* of each blade includes a raised dimple 102*r* that makes contact with the downstream face of the unison ring 106 (FIG. 9) and spaces a remainder of the support portion from said downstream face. Each blade also includes a ring-centering surface 102*c* disposed on the mounting portion 102*m* of the blade, the ring-centering surfaces of the blades contacting the radially inner periphery 106*i* of the unison ring 106 (FIG. 5) and collectively serving to radially position the unison ring such that the rotational axis of the unison ring is substantially coaxial with the rotation axis of the turbocharger. The ring-centering surfaces 102*c* have a circular-arc shape configured such that as the blade pivots because of rotation of the unison ring, the parts of the inner periphery of the unison ring in contact with the ring-centering surfaces make a rolling contact (as opposed to a relative sliding contact) with the ring-centering surfaces.

These features are advantageous for minimizing the actuation force that is required from the actuator 116 for actuating the blades 102. Because the hook portions 102*h* of the blades engage the notches 108 in the outer periphery of the unison ring 106, the lever arms of the blades can be made longer than they would be if the blades engaged the inner periphery of the unison ring. This means that the actuation force needed to pivot the blades against a given resistance (caused by friction and exacerbated by high aerodynamic loads) is reduced.

Additionally, in accordance with a second aspect of the invention, the frictional resistance to rotation of the unison ring is reduced by features of the present invention. More particularly, the surface area of the downstream face of the unison ring (the face that is urged by high aerodynamic loads against the adjacent structure) that is subject to friction is reduced by the provision of the support portions 102*s* of the blades having the raised dimples 102*r*, which space most of the surface of the support portions away from the downstream face of the unison ring. Thus, the downstream face of the unison ring makes contact only with the dimples 102*r*, which have a small collective surface area in contact with the unison ring.

Furthermore, because the unison ring makes rolling contact with the ring-centering surfaces 102*c* on the mounting portions of the blades 102, relative sliding and hence friction are reduced at these locations. It is also noteworthy that the provision of the ring-centering surfaces eliminates the need for separate ring-centering guides such as pins or rollers in the inlet-adjustment mechanism.

To further reduce friction and the actuation force required for pivoting the blades, low-friction materials are employed in strategic locations. Thus, in accordance with some embodiments of the invention, the blades 102 are constructed of plastic, which has a lower coefficient of friction than the metal typically used for the blades. Advantageously, each blade 102 and its associated pivot pin 102*p* constitute a one-piece integral part, which can be formed, for example, by injection molding or the like. The pivot pins thus have low-friction surfaces in contact with the inner surfaces of the bores in the compressor housing in which they rotate. The points of contact between the blades and adjacent parts (such as the unison ring 106 and the upstream wall 105 of the cavity for the inlet-adjustment mechanism) are likewise formed by low-friction plastic.

In this regard, the upstream wall 105 (FIG. 9) can also be formed of plastic in some embodiments of the invention. More particularly, with reference to FIGS. 3 and 4, the inlet duct member 16*d* of the compressor housing, which forms the upstream wall 105 (FIG. 9), can be an injection-molded plastic part having metal inserts MI in the holes for the metal bolts BO that fasten the duct member to the rest of the metal compressor housing 16. A further feature of the invention is the provision of a plurality of circumferentially spaced axial spacers 16*as* on the upstream wall 105 of the inlet duct member, as shown in FIG. 9. The axial spacers are effective for spacing the unison ring 106 axially away from the rest of the upstream wall, so the unison ring makes contact only with the several axial spacers.

With reference to FIG. 10, plastic is also used to advantage at the interface between the unison ring 106 and the actuator rod 117. Thus, the actuator rod advantageously comprises a center rod 117*m* of metal, but the distal end portion of the actuator rod includes a plastic cover 117*pc*. The cover can be formed by injection molding around the end of the metal rod (so-called overmolding). The end part of the actuator rod defines a groove 117*g* for receiving and engaging the protrusion 109 from the unison ring 106 (see FIG. 5). Accordingly, the unison ring contacts a low-friction plastic surface of the actuator rod.

A further aspect of the invention concerns the method for assembling the inlet-adjustment mechanism. With reference to FIGS. 3 and 4, once the blades 102 have been placed into the compressor housing cavity by inserting the pivot pins 102*p* into the bores 107*b* in the compressor housing wall 107, the unison ring 106 is then installed by orienting the unison ring in an inclined orientation with the side having the protrusion 109 lower than the opposite side of the ring, and inserting the protrusion 109 through the opening 16*o* in the compressor housing wall so as to engage the protrusion into the groove 117*g* (FIG. 10) in the actuator rod, and then the rest of the ring is lowered into position so that the notches 108 in the outer periphery of the ring engage the hooks 102*h* of the blades 102. To facilitate this installation, the ends of the hooks 102*h* preferably are chamfered to guide the insertion of the hooks into the notches. The inlet duct member/cover 16*d* is then placed on the compressor housing 16 and is bolted in place by the bolts BO.

Many modifications and other embodiments of the inventions set forth herein will come to mind to one skilled in the art to which these inventions pertain having the benefit of the teachings presented in the foregoing descriptions and the associated drawings. For example, although the illustrated embodiment employs three blades 102, the invention is not limited to any particular number of blades. The invention can be practiced with as few as two blades, or as many as 12 blades or more. The number of blades can be selected as desired. Moreover, while blades with circular-arc edges have been illustrated and described, the blades do not have to have circular-arc edges. Blades with edges of different shapes (linear, elliptical, etc.) are also included within the scope of the invention. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A turbocharger comprising:

a turbine housing and a turbine wheel mounted in the turbine housing and connected to a rotatable shaft for rotation therewith, the turbine housing receiving exhaust gas and supplying the exhaust gas to the turbine wheel;

a centrifugal compressor assembly comprising a compressor housing and a compressor wheel mounted in the compressor housing and connected to the rotatable shaft for rotation therewith, the compressor wheel defining an inducer portion, the compressor housing having an air inlet wall defining an air inlet for leading air generally axially into the compressor wheel, the compressor housing further defining a volute for receiving compressed air discharged generally radially outwardly from the compressor wheel, the compressor housing defining an annular space bounded between an upstream wall and a downstream wall spaced axially therefrom, the annular space surrounding the air inlet and being open to the air inlet at a radially inner end of the annular space; and a compressor inlet-adjustment mechanism disposed in the annular space of the compressor housing and movable between an open position and a closed position, the inlet-adjustment mechanism comprising a plurality of blades disposed within the annular space, wherein each of the blades includes an orifice portion at one end of the blade, a lever arm at an opposite end of the blade, and a mounting portion disposed intermediate the lever arm and the orifice portion, the orifice portions of the blades collectively circumscribing an orifice, the blades pivoting radially inwardly from the annular space into the air inlet when the blades are in the closed position so as to cause the orifice to have a reduced diameter relative to a nominal diameter of the inlet; and a unison ring surrounding the blades, the unison ring being rotatable about a rotational axis that is substantially coaxial with a rotation axis of the turbocharger, the unison ring having a radially inner peripheral surface and a radially outer peripheral surface, the radially outer peripheral surface defining a plurality of circumferentially spaced notches, one said notch for each said blade, each blade being supported by a pivot pin affixed to the mounting portion and rotatably engaged in a bore in the compressor housing such that the blade pivots about an axis defined by the bore, the mounting portions of the blades being disposed radially inward from the radially inner periphery of the unison ring, the lever arm of each blade including a support portion that extends radially outwardly from the mounting portion, the support portion passing adjacent to a downstream face of the unison ring and axially supporting the unison ring, each lever arm further including a hook portion that extends axially from a radially outer end of the support portion and is engaged in a respective one of the notches in the radially outer periphery of the unison ring, whereby rotation of the unison ring imparts pivotal movement to the blades via engagement of the hook portions of the lever arms in the notches in the radially outer periphery of the unison ring.

2. The turbocharger of claim 1, wherein the support portion of each blade includes a raised dimple that makes contact with the downstream face of the unison ring and spaces a remainder of the support portion from said downstream face.

3. The turbocharger of claim 1, wherein each blade includes a ring-centering surface disposed on the mounting portion of the blade, the ring-centering surfaces of the blades contacting the radially inner periphery of the unison ring and collectively serving to radially position the unison ring such that the rotational axis of the unison ring is substantially coaxial with the rotation axis of the turbocharger.

4. The turbocharger of claim 3, wherein the ring-centering surfaces are circular-arc shaped and configured such that the radially inner periphery of the unison ring makes rolling contact with the ring-centering surfaces when the unison ring is rotated and the blades pivot.

5. The turbocharger of claim 1, wherein each blade and the pivot pin therefor comprise an integral one-piece structure.

6. The turbocharger of claim 1, wherein a majority of the radially outer periphery of the unison ring lies on a circle of radius RO from the rotational axis but localized regions of the radially outer periphery in the vicinity of the notches are bulged radially outwardly to a radius RO+ΔR so that the notches lie at a radius greater than RO.

7. The turbocharger of claim 1, further comprising a linear actuator operable to rotate the unison ring, the actuator including an actuator rod, the compressor housing defining a rod bore extending along a direction tangential to the radially outer periphery of the unison ring, the actuator rod being disposed in the rod bore and being linearly movable therein, the compressor housing defining an opening that proceeds radially outwardly into the rod bore at a distal end of the actuator rod, the unison ring defining a protrusion extending radially outward from the radially outer periphery of the unison ring, the protrusion passing through said opening into the rod bore and engaging the distal end of the actuator rod such that linear movement of the actuator rod is transmitted by the protrusion to the unison ring so as to rotate the unison ring.

8. The turbocharger of claim 7, wherein the blades are plastic.

9. The turbocharger of claim 8, wherein each blade and the pivot pin therefor comprise an integral one-piece plastic part.

10. The turbocharger of claim 8, wherein the actuator rod comprises a metal rod and the distal end of the actuator rod includes a plastic cover affixed to and enveloping an end of the metal rod, wherein the protrusion of the unison ring engages the plastic cover.

11. The turbocharger of claim 1, wherein the compressor housing includes an inlet duct member that forms a portion of the air inlet wall and that forms the upstream wall in the annular space, the inlet duct member being formed separately from a remainder of the compressor housing, the inlet duct member being received into a receptacle in the remainder of the compressor housing and being affixed thereto by fasteners.

12. The turbocharger of claim 11, wherein the inlet duct member is constructed of plastic and the remainder of the compressor housing is constructed of metal.

13. The turbocharger of claim 12, wherein the inlet duct member defines a plurality of circumferentially spaced axial spacers on the upstream wall for engaging an upstream face of the unison ring and spacing the unison ring away from a remainder of the upstream wall.

* * * * *